US008351633B2

(12) United States Patent
Lassally

(10) Patent No.: US 8,351,633 B2
(45) Date of Patent: Jan. 8, 2013

(54) NOISE CANCELLING MICROPHONE WITH WIND SHIELD

(76) Inventor: Teodoro Lassally, Port Orange, FL (US)

( * ) Notice: Subject to any disclaimer, the term of this patent is extended or adjusted under 35 U.S.C. 154(b) by 1056 days.

(21) Appl. No.: 12/232,416

(22) Filed: Sep. 17, 2008

(65) Prior Publication Data

US 2010/0067727 A1 Mar. 18, 2010

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl. ..... 381/359

(58) Field of Classification Search ..... 381/359
See application file for complete search history.

(56) References Cited

U.S. PATENT DOCUMENTS

| | | | | |
|---|---|---|---|---|
| 1,232,924 | A | 7/1917 | Jackson | |
| 1,565,942 | A | 12/1925 | Jenkins | |
| 1,901,065 | A | 3/1931 | Spotts | |
| 1,907,893 | A | 5/1933 | Stevens | |
| 2,623,957 | A | 12/1952 | Cragg | |
| 3,460,080 | A * | 8/1969 | Carbonaro | 335/231 |
| 3,881,056 | A | 4/1975 | Gibson | |
| 4,263,484 | A | 4/1981 | Hisatsune | |
| D277,853 | S | 3/1985 | Thomas | |
| 4,850,016 | A | 7/1989 | Groves | |
| 5,220,608 | A | 6/1993 | Pfister | |
| 5,225,639 | A | 7/1993 | Kobayashi | |
| 5,282,245 | A | 1/1994 | Anderson | |
| 5,288,955 | A | 2/1994 | Staple | |
| 5,442,713 | A | 8/1995 | Patel | |
| 5,701,354 | A | 12/1997 | Komoda | |
| 5,889,874 | A * | 3/1999 | Schmitt et al. | 381/328 |
| 6,009,184 | A | 12/1999 | Tate | |
| D427,998 | S | 7/2000 | Tate | |
| D427,999 | S | 7/2000 | Tate | |
| D428,408 | S | 7/2000 | Tate | |
| 6,148,089 | A | 11/2000 | Akino | |
| D454,344 | S | 3/2002 | Tate | |
| 6,408,080 | B1 | 6/2002 | Koizumi | |
| 7,369,664 | B2 | 5/2008 | Kargus | |
| 2003/0221902 | A1 * | 12/2003 | Stinauer et al. | 181/130 |
| 2006/0193486 | A1 | 8/2006 | Kargus | |

FOREIGN PATENT DOCUMENTS

| | | |
|---|---|---|
| GB | 191018198 | 6/1911 |
| WO | WO 2008061808 | 5/2008 |

* cited by examiner

*Primary Examiner* — Alexander Jamal
(74) *Attorney, Agent, or Firm* — Kramer & Amado, P.C.

(57) ABSTRACT

Various exemplary embodiments are a noise-cancelling microphone housing including a body and a round wind shield member having a round depression in the end facing away from the body. The body is sized such that at least one microphone element will fit inside. The wind shield member is positioned such that in the course of normal use, wind directed toward the microphone will be intercepted and deflected by the wind-shield element. Deflecting wind away from the noise-cancelling microphone allows the microphone to produce a high-quality signal in spite of heavy winds. Various embodiments may also include a cover made of noise-damping material and/or holes through at least one face of the housing such that sound may pass through and reach the interior where the microphones are located.

20 Claims, 7 Drawing Sheets

NOISE CANCELLING MICROPHONE WITH WIND SHIELD

BACKGROUND OF THE INVENTION

1. Field of the Invention

This invention relates generally to a microphone able to capture audio in spite of ambient noise and oncoming wind.

2. Description of Related Art

Since its invention, the microphone has been used in a multitude of varying applications. Seen in consumer products such as telephones, hearing aids, and computers, as well as industry specific applications such as audio engineering, movie production, and broadcasting, the microphone has become an integral part of modern technology. The microphone is used in devices which record, amplify, and transmit sound over long distances. For all of its uses, however, the microphone has always contained one specific flaw: the capture of unwanted sound.

The basic microphone works as a catch-all, capturing all sound waves around it whether the user intends to capture them or not. This has forced many microphone users to seek out perfectly quiet areas before use, to attempt to remove unwanted sound using complex computer software, or to simply accept an imperfect capture of the sound they targeted. In some uses this may not be a problem or may actually be intended, but in many other applications a perfect capture of the desired audio is critical. Further, in some settings, the ambient noise may be so great as to entirely drown out the sound to be captured.

The noise-cancelling microphone attempts to remove ambient noise from a captured signal and, for the most part, does a satisfactory job. Noise-cancelling microphones are sensitive to sound one two opposite sides. One "capture side" is oriented toward the source of the desired sound, and another "cancelling side" is oriented away from the source of desired sound. Both sides still capture all ambient noise, but the cancelling side does not pick up the sound from the desired source. The noise-cancelling microphone then uses the signal from the cancelling side to cancel out part of the signal from the capture side, ideally leaving only the sound captured from the desired sound source and nothing more.

One arrangement of a noise-cancelling microphone is a bidirectional or "Figure-8" microphone. This type of microphone includes a front and a back side, but includes only one voice coil. Thus, as described above, the front of the voice coil serves as the capture side, while the back of voice coil serves as the cancelling side.

While the noise-cancelling microphone performs well when cancelling out ambient noise picked up by both sides, it ignores the effect of sound and other vibrations directed toward and picked up by the cancelling side only. Any sound picked up by the cancelling side but not the capture side will introduce new noise into the final signal during the noise-cancelling process, thus defeating the purpose of the noise-cancelling microphone in the first place. Such sounds could result from a person speaking directly in front of the cancelling side or wind directed toward the cancelling side. Wind-induced noise is especially troublesome in areas such as motorsports, where noise-cancelling microphones are often used.

In many motorsports, drivers use headsets employing noise-cancelling microphones to communicate with their crew chief or other team members throughout the race while cancelling out the sound of the vehicle's engine. Such communication is critical to the driver's safety and performance, as it enables the driver to know much more about the state of the racetrack than can be immediately observed and to plan strategies with team members to avoid accidents and pass opponents. Not all motorized vehicles confer the benefit of a full windshield, however, exposing the driver to a constant, high-power headwind. As explained above, such a headwind would be directed toward the cancelling side of the noise-cancelling microphone, resulting in the addition of wind noise to the final, post-cancellation signal. Foam windshields have been developed to attempt to alleviate this problem, but prove to be imperfect solutions, particularly when the force of the wind is strong, as in motorsports applications.

Accordingly, there is a need for a noise-cancelling microphone that is able to cope with sounds directed toward the cancelling side, but not the capture side. In addition, there is a need for a microphone that is able to overcome the effects of heavy wind and still produce a quality signal of the sound intended to be captured.

The foregoing objects and advantages of the invention are illustrative of those that can be achieved by the various exemplary embodiments and are not intended to be exhaustive or limiting of the possible advantages which can be realized. Thus, these and other objects and advantages of the various exemplary embodiments will be apparent from the description herein or can be learned from practicing the various exemplary embodiments, both as embodied herein or as modified in view of any variation that may be apparent to those skilled in the art. Accordingly, the present invention resides in the novel methods, arrangements, combinations, and improvements herein shown and described in various exemplary embodiments.

SUMMARY OF THE INVENTION

In light of the present need for a microphone able to effectively overcome the effects of heavy wind, a brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

According to the foregoing, various exemplary embodiments provide a microphone housing comprising a body sized to contain at least one microphone element and a connected member with a round depression connected to the body such that it will shield at least one of the body's faces from oncoming wind. Some embodiments comprise only the housing, while other embodiments comprise the housing in combination with a microphone element.

In various exemplary embodiments, the connected member is horn-shaped, while in other embodiments the connected member is bowl-shaped and connected to the body via a stalk section. In some embodiments wherein the connected member is horn shaped, the horn is tapered such that the horn appears to open away from the body of the housing. In some embodiments, the shape of the connected member may be described mathematically as the surface or volume traced by a curve segment or geometric surface when revolved around a central axis. In some embodiments, this curve is concave up with respect to the central axis.

In various exemplary embodiments, the body contains a plurality of holes, such that vibrations may reach the interior of the body where the microphones are housed. Various exemplary embodiments employ further means to dampen wind and other noise, such as a noise-damping cover. In some of these embodiments, the noise-damping cover is simply a dome of noise-damping material affixed to the side into which the user speaks, covering the aforementioned plurality of holes, if present. In some embodiments, the shaped of the dome cover may be described mathematically as the surface traced by a circular arc rotating around a bisecting axis. In other embodiments, the noise-damping cover is a sheath that surrounds at least part of the body. In some embodiments, the sheath contains a hole through which the connected member may extend and remain uncovered.

BRIEF DESCRIPTION OF THE DRAWINGS

In order to better understand various exemplary embodiments, reference is made to the accompanying drawings, wherein.

DETAILED DESCRIPTION OF THE PREFERRED EMBODIMENTS OF THE INVENTION

Figure 1:
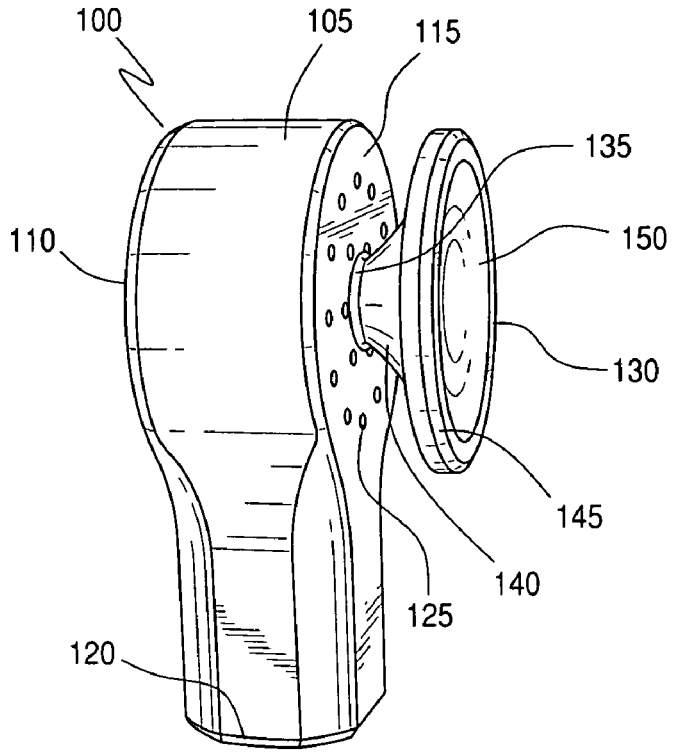
FIG. 1 shows a perspective view of an exemplary noise-cancelling microphone with a wind shield.

Referring now to the drawings, in which like numerals refer to like components or steps, there are disclosed broad aspects of various exemplary embodiments.

The following description focuses on the design of housings for microphones. It should be apparent that any suitable microphone element may be placed into the housings described below with reference to FIGS. 1 through 11. This microphone element may be, for example, a basic microphone, a bidirectional or "Figure8" microphone, or two microphones in a noise-cancelling configuration. Other suitable microphone elements for use in the housings described herein will be apparent to those of skill in the art.

FIG. 1 shows a perspective view of an exemplary embodiment of a noise-cancelling microphone 100 including a wind shield member 130. In various embodiments, microphone 100 includes a body 105, a speaking face 110, a cancelling face 115, a bottom end 120, a plurality of holes (not shown) through the speaking face 110, a plurality of holes 125 through the cancelling face 115, and a wind shield member 130. Wind shield member 130 may comprise a connection segment 135, an outer wall 140, a rim 145, and a round depression 150.

In various exemplary embodiments, body 105 is composed of plastic, metal, or wood. It should be apparent, however, that any suitable material may be used. Body 105 may be fully or partially hollow, such that at least one microphone element may be housed inside of body 105. Alternatively, body 105 could be completely solid and formed around at least one microphone element.

Speaking face 110 may be located on the front of body 105. When microphone 100 is in use, the user directs his or her mouth toward speaking face 105. Speaking face may simply be the front side of body 105 or may be another piece attached to body 105, composed of plastic, metal, wood, or another suitable material. Likewise, cancelling face 115 may be located on the back of the body 105. Cancelling face 115 may either be the back side of body 105 or another piece attached to the back of body 105, composed of plastic, metal, wood, or other suitable material.

Bottom end 120 may be located at the bottom of body 105. As described further below with reference to FIG. 6, bottom end 120 may contain a recess 657 suitable for mounting noise cancelling microphone 100 on the end of a boom, handle, headset, or other apparatus. Alternatively, bottom end 120 might not contain any recess and simply serve as an end on which to stand noise-cancelling microphone 100.

As described further below with reference to FIG. 4, various embodiments contain a plurality of holes 455 through speaking face 110, such that sound vibrations pass through speaking face 110 and reach the interior of body 105. Likewise, various embodiments also contain a plurality of holes 125 through cancelling face 115, such that sound vibrations pass through cancelling face 115 and reach the interior of body 105.

In various exemplary embodiments, noise-cancelling microphone 100 contains a wind shield member 130. Wind shield member 130 may be composed of plastic, metal, wood, or any other suitable material. In various embodiments, wind shield member 130 is connected to the cancelling face 115. In other embodiments, wind shield member 130 is connected to any part of body 105. Wind shield member 130 may be positioned such that any oncoming wind or vibrations directed toward the cancelling face 115 will first be intercepted by wind shield member 130.

Wind shield member 130 may further comprise at least one connection segment 135, an outer wall 140, a rim 145, and a round depression 150. Connection segment 135 may serve to connect wind shield member 130 to cancelling face 115 or to any other point on body 105. Connection segment 135 may be attached to outer wall 140 or to rim 145.

In various embodiments, outer wall 140 is connected to any combination of: connection segment 135, rim 145, and round depression 150. For example, outer wall 140 may connect to connection segment 135 and rim 145, but not directly to round depression 150. In various embodiments, a cross section of outer wall 140 may be circular, ovoid, elliptical, or any other roughly round two-dimensional figure. Outer wall 140 might taper as it nears body 105, giving outer wall 140 a shape reminiscent of a horn. Alternatively, outer wall 140 may be bowl-shaped or may have walls perpendicular to the cancelling face 115.

Various embodiments of wind shield member 130 contain a rim 145 which may be connected to any combination of the following: connection segment 135, outer wall 140, and round depression 150. For example, rim 145 might connect to outer wall 140 and round depression 150, but not connection segment 135. In various embodiments, wind shield member 130 contains a round depression 150 which is connected to any combination of the following: connection segment 135, outer wall 140, and rim 145. For example, round depression 150 may connect only to rim 145. Round depression 150 may be a relief shaped similar to outer wall 145 or may be a relief with a shape of its own. Depression 150 may be trumpet-shaped, bowl-shaped, or shaped similar to a portion of a sphere, ellipsoid, or other roughly round three-dimensional figure.

Figure 2:
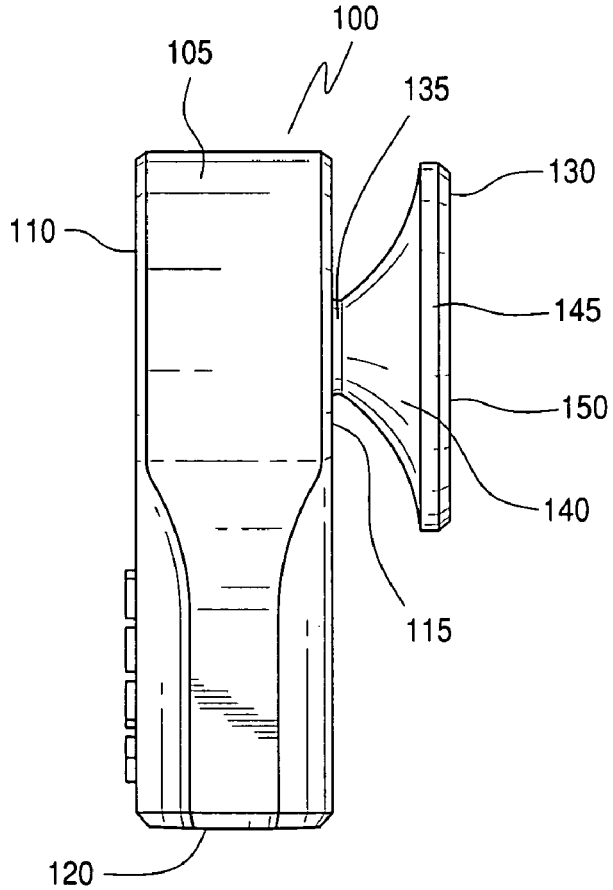
FIG. 2 shows a side elevational view of an exemplary noise-cancelling microphone with a wind shield.

FIG. 2 shows a side elevational view of an exemplary embodiment of a noise-cancelling microphone 100 including a wind shield 130. In this view, one may more easily see the profile of the wind-shield member 130.

Figure 3:
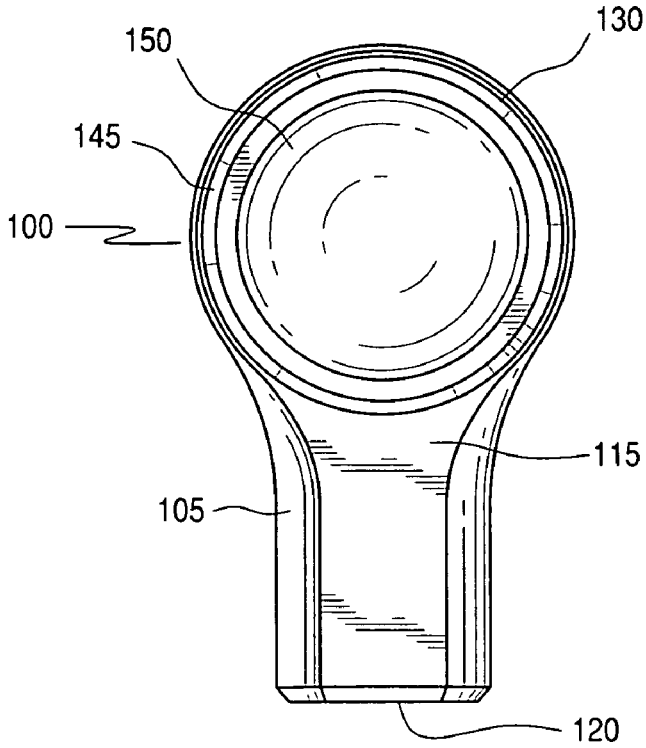
FIG. 3 shows a rear elevational view of an exemplary noise-cancelling microphone with a wind shield.

FIG. 3 shows a rear elevational view of an exemplary embodiment of a noise-cancelling microphone 100 including a wind shield 130. From this view, one is able to see into the round depression 150 of wind shield element 130. It should be apparent from this view that a cross section of the depression 150 may reveal a circle, oval, ellipse, or other substantially round geometric figure. The cross-section of round depression 150 may be continuously curved or it may be a polygonal approximation to a curved or rounded figure.

Round depression 150 may be shaped similarly to outer wall 140. For example, if outer wall 140 is horn-shaped, round depression 150 might also be horn-shaped. Alternatively, round depression 150 may have a shape that is unique with respect to the shape of outer wall 140. As shown in the figures, outer wall 140 may be horn-shaped while round depression 150 is bowl-shaped.

Figure 4:
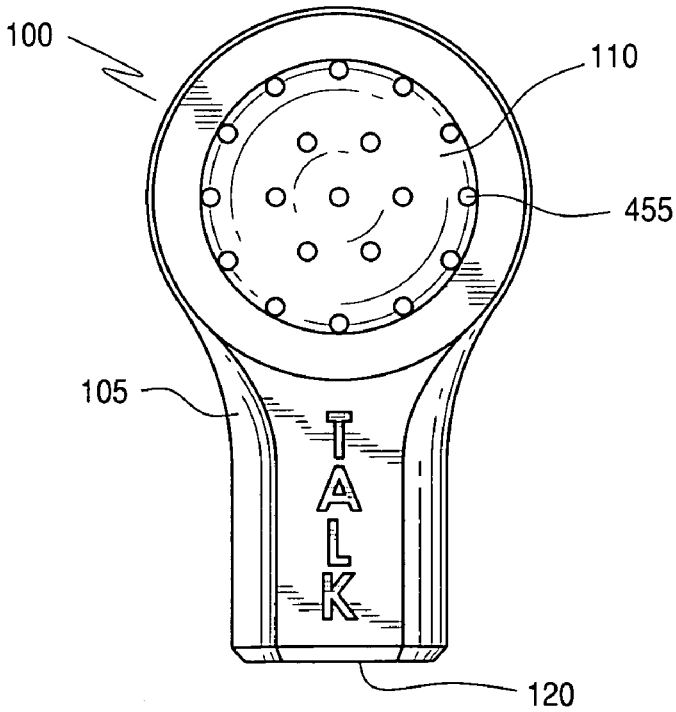
FIG. 4 shows a front elevational view of an exemplary noise-cancelling microphone with a wind shield.

FIG. 4 shows a front elevational view of an exemplary embodiment of a noise-cancelling microphone 100 including a wind shield 130. This view shows the aforementioned plurality of holes 455 through speaking face 110. The plurality of holes 455 may allow vibrations to pass through speaking face 110 and reach the interior of body 105.

Figure 5:
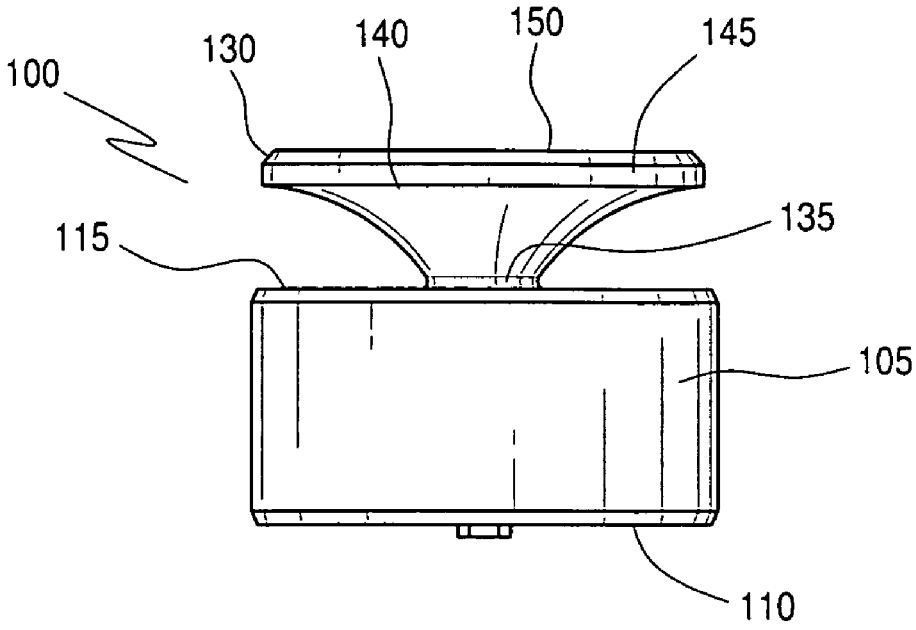
FIG. 5 shows a top elevational view of an exemplary noise-cancelling microphone with a wind shield.

FIG. 5 shows a top elevational view of an exemplary embodiment of noise-cancelling microphone 100 including a wind shield 130. One can see from this view that the top view of wind shield element 130 may be similar or identical to the side view of wind shield element 130 seen in FIG. 2, indicating the wind shield element 130 may be rounded.

Figure 6:
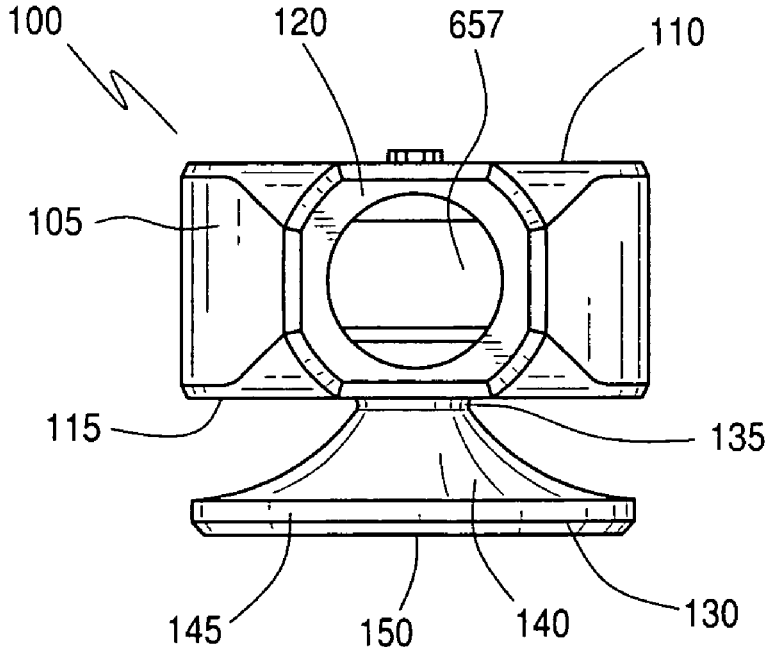
FIG. 6 shows a bottom elevational view of an exemplary noise-cancelling microphone with a wind shield.

FIG. 6 shows a bottom elevational view of an exemplary embodiment of noise-cancelling microphone 100 including a wind shield 130. Bottom end 120 may be seen more clearly in this figure. Bottom end 120 may contain a hole 657, such that a handle, boom, headset, or other object may be inserted in order to mount noise-cancelling microphone 100. The microphone 100 may be affixed to the object via a screw, adhesive, pin, or other appropriate means. Alternatively, the bottom end 120 may not have an opening, instead functioning as the end on which to stand the microphone 100 for use.

Figure 7A:
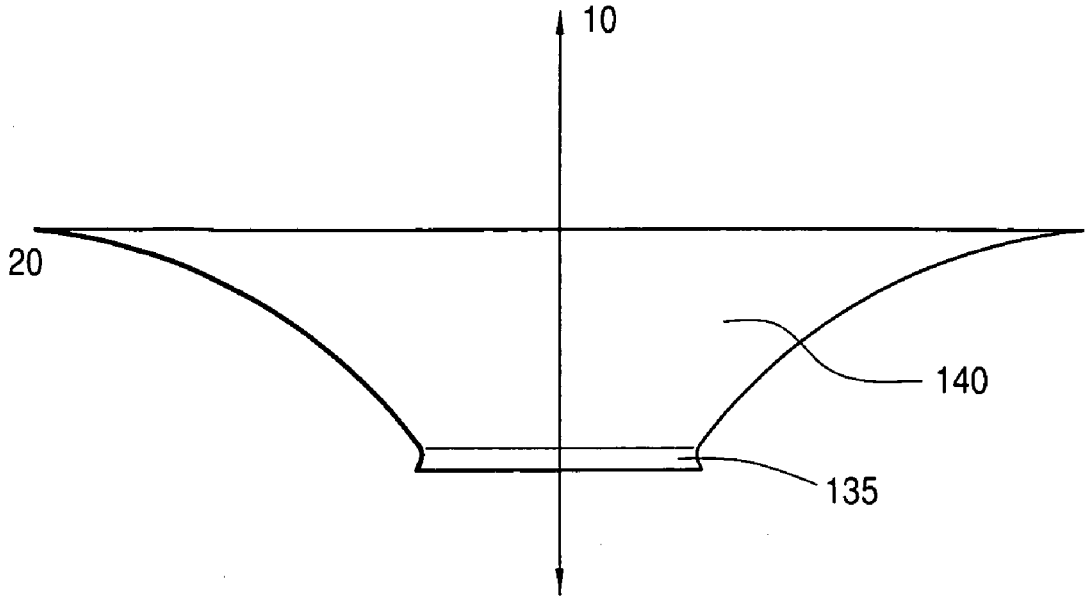
FIG. 7A shows a side view of the outer wall and the connection segment of the wind shield member, showing formation by revolving a curve around a central axis.

FIG. 7A illustrates a mathematical description of one embodiment of connection segment 135 and outer wall 140 of the wind-breaking member 130. Two-dimensional curve segment 20 lies in the same plane as axis 10. FIG. 7A is merely an example of one embodiment. Thus, two-dimensional curve segment 20 may be any curve segment. When revolved in three dimensions around imaginary axis 10, two-dimensional curve 20 traces out the three-dimensional surface to be used for connection segment 135 and outer wall 140.

Figure 7B:
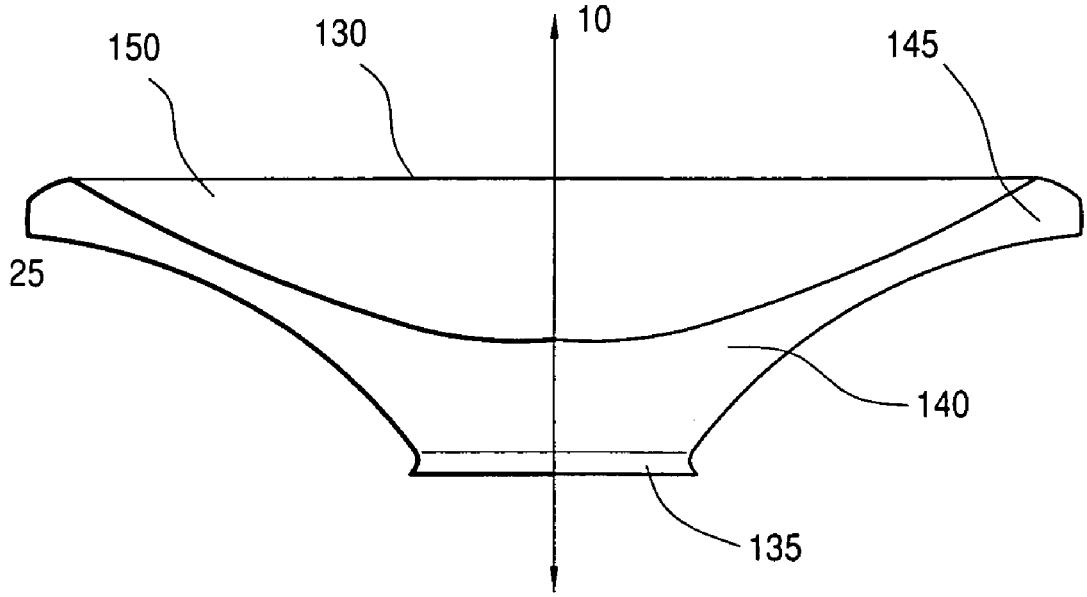
FIG. 7B shows a cross-sectional view of the wind shield member from FIG. 1, showing formation of the entire member by revolving a geometric circuit around a central axis.

FIG. 7B further shows how the entire wind shield member 130 may be described mathematically. Geometric circuit 25 may be composed of zero or more curves and zero or more line segments, the curves and line segments forming a closed path. Geometric circuit 25 may share at least one edge with imaginary axis 10. When revolved around imaginary axis 10, geometric circuit 25 traces a three-dimensional volume for use as wind shield member 130. As can be seen in the example of FIG. 7B, the outer wall 140 may be horn-shaped while the round depression 150 might be bowl-shaped. Any closed path may be used to form the wind shield member 130 by rotation, so long as the rotation will result in a solid having an outer wall 140 and a round depression 150.

Figure 8A:
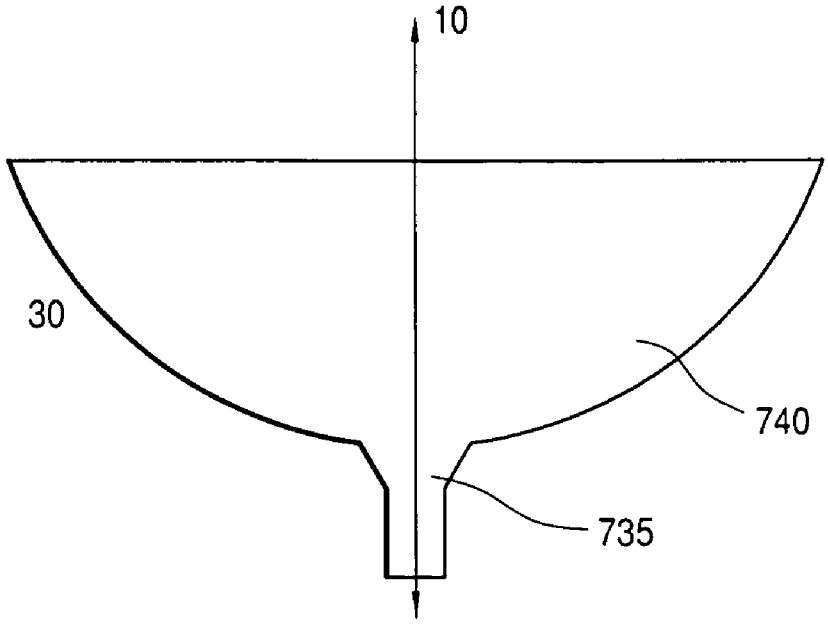
FIG. 8A shows a side view of an alternative outer wall and connection segment for the wind shield member, showing formation by revolving a curve around a central axis.

FIG. 8A shows a side view of an alternative outer wall 840 and connection segment 835 for the wind shield member 130, showing formation by revolving a curve around a central axis. Two-dimensional curve 30 defines the edges of alternative connection segment 835 and alternative outer wall 840. As described above with reference to FIG. 7A, two-dimensional curve 30 is revolved in three dimensions about imaginary axis 10, tracing a three-dimensional surface for use as connection segment 835 and outer wall 840. In this exemplary embodiment, outer wall 840 is bowl-shaped and connection segment 835 is a stalk which extends a short distance to connect outer wall 840 to some point on body 105.

Figure 8B:
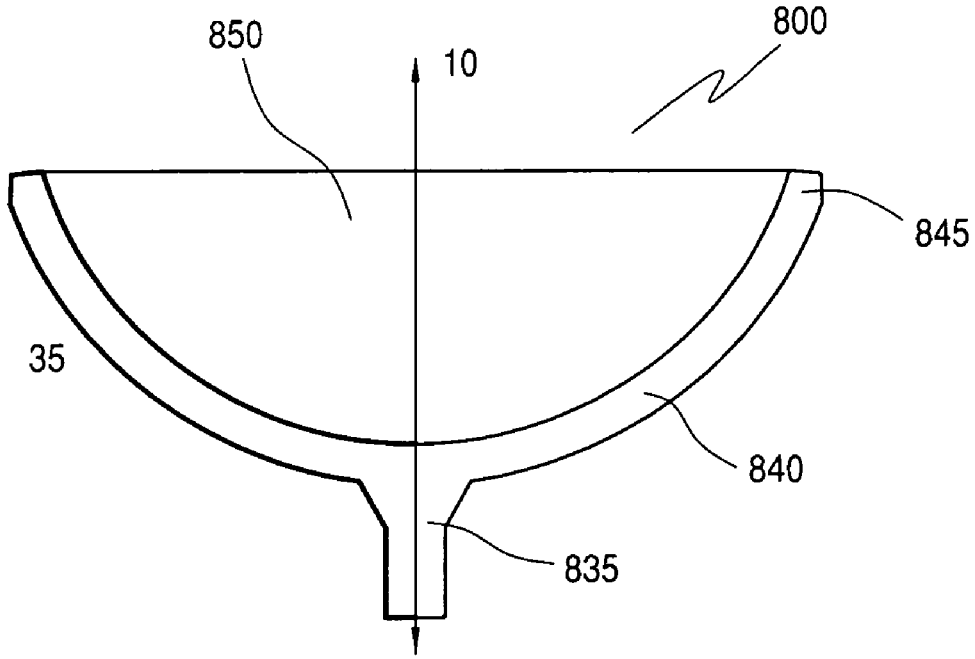
FIG. 8B shows a cross-sectional view of an alternative windshield member, showing formation of the entire member by revolving a geometric circuit around a central axis.

FIG. 8B shows how a full alternative wind shield member 830 may be defined mathematically. Geometric circuit 35 may be composed of zero or more curves and zero or more line segments, the curves and line segments forming a closed path. Geometric circuit 35 may share at least one edge with imaginary axis 10. When revolved around imaginary axis 10, geometric circuit 35 traces a three-dimensional volume for use as wind shield member 830. Alternative wind-shield member 830 comprises connection segment 835, outer wall 840, rim 845, and round depression 850. As can be seen in the example of FIG. 8B, the outer wall 840 and round depression 850 may both be bowl-shaped. Again in the example of FIG. 8B, connection segment 835 takes the form of a short stalk which holds the rest of alternative wind shield element 830 at some distance away from body 105.

Figure 9:
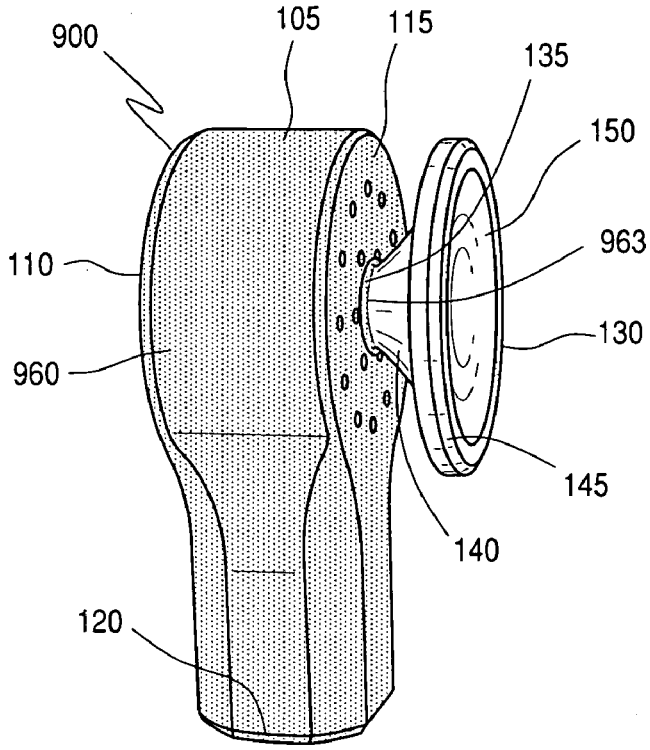
FIG. 9 shows a perspective view of an alternative embodiment of a noise-cancelling microphone with a wind shield, the microphone having a sheath around the body section.

FIG. 9 shows a perspective view of an alternative embodiment of a noise-cancelling microphone 900 with a wind shield 130. In this embodiment, the noise-cancelling microphone 900 may comprise any combination of the elements previously described with reference to FIG. 1, with the addition of a wind sheath 960. Wind sheath 960 might be composed of foam, fur, or any other material suitable to dampen vibrations and protect microphone 900 from exposure to moisture. Wind sheath 960 might cover the entire body 105 or only a portion thereof. Further, wind sheath 960 may comprise a hole or slit 963 through which wind shield member 130 may pass, thereby allowing wind shield member 130 to remain uncovered by wind sheath 960.

Figure 10:
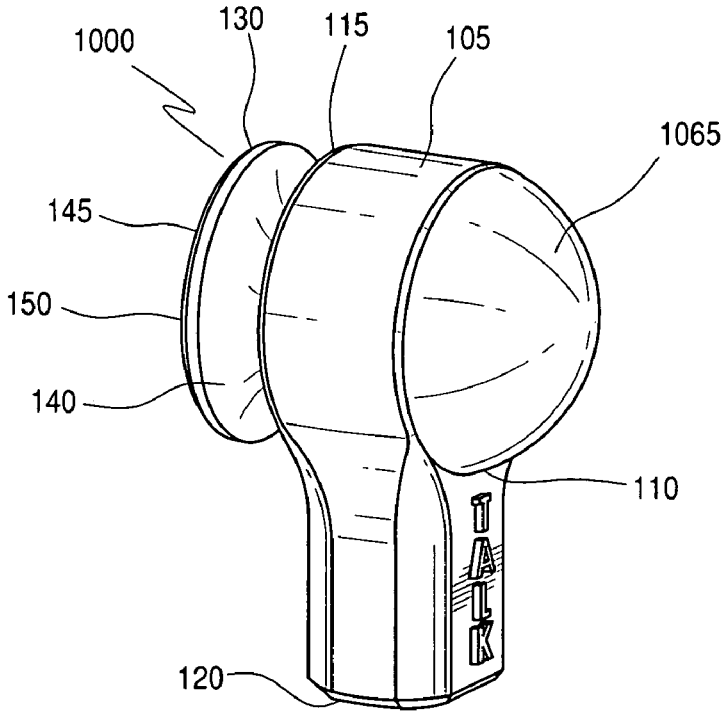
FIG. 10 shows a perspective view of an alternative embodiment of a noise-cancelling microphone with a wind shield, the microphone having a dome-shaped cover over the speaking face.

FIG. 10 shows a perspective view of another alternative embodiment of a noise-cancelling microphone with a wind shield 1000. In this embodiment, the noise-cancelling microphone 1000 may comprise any combination of the elements previously described with reference to FIG. 1 with the addition of a dome cover 1065. Dome cover 1065 is roughly dome-shaped and may be composed of foam, fur, or any other material suitable to dampen vibrations and absorb moisture. Dome cover 1065 may be attached to speaking face 110, such that it covers the plurality of holes 455, as discussed above with reference to FIG. 4.

Figure 11:
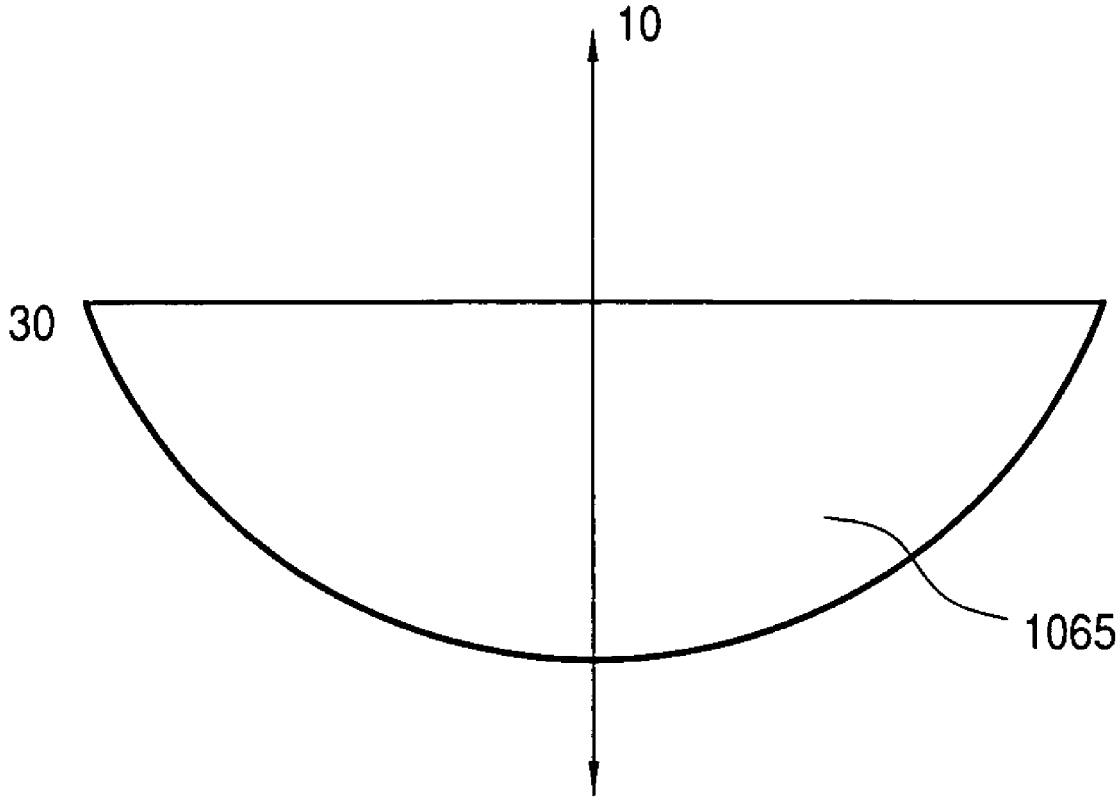
FIG. 11 shows a side view of the dome-shaped cover, showing formation by rotating a circular arc around a bisecting axis.

Referring now to FIG. 11, the shape of dome cover 1065 may be described mathematically. Arc 30 may be a substantially circular arc, which can be of any radius and length and may take the form of a semicircle or some other portion of a circle. Arc 30 may be a perfect curve, a curve with minor irregularities, or a piecewise linear approximation to a curve. Arc 30 is positioned such that imaginary axis 10 substantially bisects arc 30. When arc 30 is rotated about imaginary axis 10, it may trace the shape to be used for dome cover 1065. It should be apparent that other dome shapes may result when arcs of different radii and lengths are used in the above described process.

According to the foregoing, various exemplary embodiments utilize a round wind shield member to deflect wind. This member prohibits oncoming wind from interfering with the noise-cancelling microphone, allowing the microphone to capture a quality signal in spite of heavy winds. Furthermore, various exemplary embodiments include a round depression on the end of the wind-shield member, allowing the wind-shield member to further reduce the amount of wind that interferes with the noise-cancelling microphone.

While the foregoing description has spoken in terms of improvements for noise cancelling microphones, it should be understood that the improvements described might be applied to any form of microphone for which a wind-blocking capability is desirable.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

What is claimed is:

1. A housing for a microphone, the housing comprising:

a body sized to receive at least one microphone element; and a connected member comprising a substantially round depression, wherein the connected member connects to a first face of the body such that the connected member shields at least one face of the body from oncoming wind, wherein the first face includes a first plurality of holes and a second face of the body that is opposite of the first face includes a second plurality of holes.

2. The housing of claim 1, wherein the connected member further comprises:

a bowl-shaped section; and a stalk section connecting the bowl section to the body of the housing.

3. The housing of claim 1, wherein the connected member is horn-shaped.

4. The housing of claim 3, wherein the connected member is attached to the body such that an opening of the horn shape faces away from the body.

5. The housing of claim 1, further comprising a cover.

6. The housing of claim 5, wherein the cover is dome-shaped and affixed to a second face of the body opposite the first face.

7. The housing of claim 5, wherein the cover is a sheath that covers at least a portion of body.

8. The housing of claim 7, wherein the cover has a hole such that the connected member may pass through the hole and remain uncovered.

9. A housing for a noise cancelling microphone, the housing comprising:

a body sized to receive at least one noise-cancelling microphone element, wherein a first face of the body comprises a plurality of holes, and a second face of the body comprises a plurality of holes and is opposite the first side; and a connected member, comprising a substantially round indentation, wherein the connected member is attached to a first side of the body, such that the connected member will shield at least one face of the body from oncoming wind.

10. The housing of claim 9, further comprising a cover.

11. The housing of claim 10, wherein the cover has the shape of a surface traced by a circular arc rotated around an axis bisecting the arc.

12. The housing of claim 9, wherein the connected element is horn-shaped.

13. The housing of claim 9, wherein the connected element comprises a surface traced by a curve segment revolved 360 degrees around a central axis.

14. The housing of claim 9, wherein the connected element comprises a volume traced by a geometric circuit revolved 360 degrees around a central axis.

15. A noise-cancelling microphone comprising:

a hollow body comprising a plurality of holes, a speaking face, and a cancelling face opposite the speaking face;

a microphone element positioned inside the body, wherein the microphone element is configured to cancel noise detected through the cancelling face from sound detected through the speaking face; and a horn-shaped member that is attached to the cancelling face of the body, such that the horn-shaped member shields the cancelling face of the body from oncoming wind.

16. The microphone of claim 15, further comprising a cover.

17. The microphone of claim 16, wherein the cover is dome-shaped and affixed to the speaking face of the body.

18. The microphone of claim 16, wherein the cover is a sheath which covers at least a portion of the body.

19. The microphone of claim 18, wherein the cover comprises a hole through which the horn-shaped member extends and remains uncovered.

20. The microphone of claim 15, wherein the hollow body further comprises a recess for receiving an end of a boom.

* * * * *